US008549693B2

(12) United States Patent
Gruber et al.

(10) Patent No.: US 8,549,693 B2
(45) Date of Patent: Oct. 8, 2013

(54) TOOTH CLEANING DEVICE

(75) Inventors: Jack Gruber, Great Neck, NY (US); Edward Kozloski, Babylon, NY (US)

(73) Assignee: Gruber, LLC, Great Neck, NY (US)

( * ) Notice: Subject to any disclaimer, the term of this patent is extended or adjusted under 35 U.S.C. 154(b) by 203 days.

(21) Appl. No.: 13/091,063

(22) Filed: Apr. 20, 2011

(65) Prior Publication Data

US 2012/0266401 A1 Oct. 25, 2012

(51) Int. Cl.

| | |
|---|---|
| ***A46B 3/22*** | (2006.01) |
| ***A46B 1/00*** | (2006.01) |
| ***A46B 5/04*** | (2006.01) |

(52) U.S. Cl.

USPC ..... 15/167.1; 15/176.4; 15/188; 601/139; 601/141

(58) Field of Classification Search

USPC ..... 15/167.1, 176.1, 176.4–176.6, 187, 15/188; 601/139, 141, 137, 138; D4/104, D4/136, 137; D24/211, 214

See application file for complete search history.

(56) References Cited

U.S. PATENT DOCUMENTS

| | | | | |
|---|---|---|---|---|
| 147,410 A | | 2/1874 | La Fonte | |
| 323,305 A | | 7/1885 | Evans | |
| 388,253 A | | 8/1888 | Bowers | |
| 659,593 A | * | 10/1900 | Richards | 15/188 |
| 686,764 A | * | 11/1901 | Richards | 15/188 |
| 877,585 A | | 1/1908 | Nicolai | |
| 1,073,155 A | | 9/1913 | Miller | |
| 1,270,536 A | | 6/1918 | Maher | |
| 1,327,757 A | * | 1/1920 | Eggers | 401/28 |
| 1,347,275 A | | 7/1920 | Iden | |
| 1,364,996 A | | 1/1921 | Jordan | |
| 1,371,790 A | | 3/1921 | Kelly | |
| 1,620,990 A | | 3/1927 | Brothers | |
| 1,673,638 A | | 6/1928 | Peterson | |
| 1,729,167 A | | 9/1929 | Knapp | |
| 1,797,946 A | * | 3/1931 | Emil | 401/184 |
| 1,800,993 A | | 4/1931 | Funk | |
| 1,801,915 A | | 4/1931 | Gray | |
| 1,817,585 A | * | 8/1931 | Max | 15/188 |

(Continued)

FOREIGN PATENT DOCUMENTS

| | | |
|---|---|---|
| CA | 2334841 | 12/1999 |
| DE | 3621815 | 1/1988 |

(Continued)

OTHER PUBLICATIONS

International Search Report issued on Oct. 25, 2012 for PCT/US2012/032943 filed on Apr. 10, 2012. 3 pages.

*Primary Examiner* — Mark Spisich
(74) *Attorney, Agent, or Firm* — Collard & Roe, P.C.

(57) ABSTRACT

A tooth cleaning device comprising a handle, and a pad coupled to the handle, wherein the pad has a front face, a back face and a plurality of side walls. There are a plurality of different areas disposed on the front face of the pad comprising a first area comprising a first set of protrusions, in a substantially semi-spherical shape, and a second area comprising a second set of protrusions in a substantially conical shape. There is also a third area of protrusions formed as a substantially conical shape, and a fourth area of protrusions formed as a substantially semi-spherical shape. The device can be formed as a pad which collapses voluntarily under pressure. The pad can be made from any suitable material such as any type of rubber or plastic.

17 Claims, 16 Drawing Sheets

(56) References Cited

U.S. PATENT DOCUMENTS

| | | | | | |
|---|---|---|---|---|---|
| 1,833,555 | A | * | 11/1931 | Bell et al. | 15/188 |
| 1,908,510 | A | | 5/1933 | Dodson | |
| 1,924,337 | A | | 8/1933 | Troupa | |
| 1,968,303 | A | | 7/1934 | McMath | |
| 1,987,390 | A | | 1/1935 | Davis | |
| 2,092,987 | A | | 9/1937 | Remington | |
| 2,101,363 | A | | 12/1937 | De Rome | |
| 2,103,083 | A | * | 12/1937 | Lynch | 601/139 |
| 2,111,238 | A | * | 3/1938 | Doyle | 15/188 |
| D118,268 | S | | 12/1939 | Salit | |
| 2,206,726 | A | * | 7/1940 | Lasater | 15/188 |
| 2,217,439 | A | | 10/1940 | Fuller | |
| 2,218,738 | A | | 10/1940 | Boysen | |
| 2,225,331 | A | | 12/1940 | Campbell | |
| 2,279,355 | A | * | 4/1942 | Wilensky | 15/110 |
| 2,476,201 | A | | 7/1949 | Ligoure | |
| 2,517,045 | A | | 8/1950 | Soule | |
| 2,600,136 | A | | 6/1952 | Staunt | |
| 2,618,003 | A | | 11/1952 | Robey | |
| 2,642,604 | A | * | 6/1953 | Ferrari | 15/110 |
| 2,668,973 | A | | 2/1954 | Glaza et al. | |
| 2,686,325 | A | * | 8/1954 | Louis | 15/188 |
| 2,706,825 | A | * | 4/1955 | Blakeman | 15/176.4 |
| 2,719,315 | A | | 10/1955 | Sheehan | |
| 2,736,917 | A | | 3/1956 | Goldstein et al. | |
| 2,877,483 | A | | 3/1959 | Alvistur | |
| 2,985,167 | A | | 5/1961 | Colb | |
| 3,007,441 | A | * | 11/1961 | Eyer | 433/1 |
| 3,010,131 | A | | 11/1961 | Kisky | |
| 3,018,778 | A | | 1/1962 | Brilliant | |
| 3,043,295 | A | * | 7/1962 | Ward | 601/139 |
| 3,067,446 | A | | 12/1962 | McGauley | |
| 3,174,174 | A | | 3/1965 | Dengler | |
| 3,267,512 | A | | 8/1966 | Wiley | |
| 3,321,796 | A | | 5/1967 | Lelicoff | |
| 3,332,103 | A | | 7/1967 | Case | |
| 3,337,893 | A | | 8/1967 | Fine et al. | |
| 3,458,268 | A | | 7/1969 | Wozab et al. | |
| 3,467,979 | A | | 9/1969 | Bohlmann | |
| 3,491,396 | A | | 1/1970 | Eannarino et al. | |
| 3,934,299 | A | | 1/1976 | Regester | |
| 4,083,078 | A | | 4/1978 | Shimizu | |
| 4,115,893 | A | * | 9/1978 | Nakata et al. | 15/110 |
| 4,128,910 | A | | 12/1978 | Nakata et al. | |
| 4,195,625 | A | | 4/1980 | Bukowski | |
| 4,205,664 | A | | 6/1980 | Baccialon | |
| D259,976 | S | | 7/1981 | Seelig | |
| 4,319,379 | A | | 3/1982 | Carrigan et al. | |
| 4,323,347 | A | | 4/1982 | Weissman | |
| 4,411,041 | A | | 10/1983 | Braga | |
| 4,486,109 | A | | 12/1984 | Rosofsky | |
| 4,543,679 | A | | 10/1985 | Rosofsky et al. | |
| 4,628,564 | A | | 12/1986 | Youssef | |
| 4,638,521 | A | | 1/1987 | Potente et al. | |
| 4,679,274 | A | | 7/1987 | Friedman | |
| 4,731,896 | A | | 3/1988 | de La Tour | |
| 4,770,195 | A | | 9/1988 | Dore | |
| 4,831,676 | A | | 5/1989 | Denmark | |
| 4,890,349 | A | | 1/1990 | Nitzsche | |
| 5,027,796 | A | | 7/1991 | Linzey | |
| 5,040,260 | A | | 8/1991 | Michaels | |
| D319,735 | S | | 9/1991 | Hodosh et al. | |
| 5,158,383 | A | | 10/1992 | Glover et al. | |
| 5,158,532 | A | | 10/1992 | Peng et al. | |
| 5,224,234 | A | | 7/1993 | Arsenault et al. | |
| 5,247,718 | A | | 9/1993 | Victorian | |
| 5,273,425 | A | | 12/1993 | Hoagland | |
| 5,396,679 | A | | 3/1995 | Brown et al. | |
| 5,407,358 | A | | 4/1995 | Gruber | |
| 5,471,701 | A | | 12/1995 | Parfenie | |
| 5,499,422 | A | | 3/1996 | Lavazoli | |
| 5,500,973 | A | | 3/1996 | Phelan | |
| 5,511,276 | A | | 4/1996 | Lee | |
| 5,555,590 | A | | 9/1996 | Blum et al. | |
| D388,253 | S | | 12/1997 | Ra | |
| 5,737,792 | A | | 4/1998 | Quigless | |
| 5,774,925 | A | | 7/1998 | Pryor, III | |
| D402,472 | S | | 12/1998 | Chen | |
| 5,864,915 | A | | 2/1999 | Ra | |
| 5,875,513 | A | | 3/1999 | Reinold | |
| 5,896,614 | A | | 4/1999 | Flewitt | |
| 5,930,860 | A | * | 8/1999 | Shipp | 15/110 |
| 6,067,684 | A | | 5/2000 | Kweon | |
| 6,126,444 | A | | 10/2000 | Horiguchi | |
| 6,205,611 | B1 | | 3/2001 | Vigil | |
| 6,336,461 | B1 | | 1/2002 | Martinez | |
| 6,374,448 | B2 | * | 4/2002 | Seifert | 15/110 |
| 6,408,473 | B1 | | 6/2002 | Kessler | |
| 6,510,576 | B1 | | 1/2003 | Gruber | |
| D490,247 | S | | 5/2004 | Nanda | |
| 6,957,467 | B2 | | 10/2005 | Cabedo-Deslierres et al. | |
| D607,647 | S | | 1/2010 | Gruber | |

FOREIGN PATENT DOCUMENTS

| | | | |
|---|---|---|---|
| GB | 1592513 | | 7/1981 |
| JP | 02-180203 | | 7/1990 |
| JP | 10-158591 | | 6/1998 |
| JP | 2000-050955 | | 2/2000 |
| JP | 2004-249061 | * | 9/2004 |
| JP | 2010-51795 | * | 3/2010 |

* cited by examiner

TOOTH CLEANING DEVICE

BACKGROUND OF THE INVENTION

The invention relates to a tooth cleaning device which is configured to clean teeth without using standard bristles of a toothbrush.

It is well known that dental plaque is the major cause of periodontal disease. Broadly, plaque consists of an adhesive mass of bacteria, mucins, food and other organic matter which, if present for long enough on the teeth, calcifies to form calculus. Consequently, it is appreciated that the effective and complete removal of plaque is essential to the maintenance of good oral hygiene.

The removal of plaque from the oral tissues at an early stage of its development may be achieved by brushing. However, if calcification occurs, then the resultant calculus may only be removed by vigorous mechanical action, usually performed by a dentist. It is therefore important to ensure plaque removal before calcification occurs.

Devices have been developed for clearing the food particles and bacteria from the mouth and teeth. The most well-known and commonly used devices are toothbrushes with bristles that are moved across the teeth to remove food residue and plaque from the enamel surface, as well as larger food particles trapped in between teeth. Toothpicks and dental floss are also frequently used to extract smaller food particles that become trapped between teeth.

However, brushing of teeth with a standard toothbrush can be harmful and can cause the removal of not just plaque but also the enamel on teeth.

Therefore, it is believed that there is a need for a device configured to clean teeth which does not include bristles which can strip away plaque on teeth while still cleaning these teeth sufficiently without removing essential enamel.

SUMMARY OF THE INVENTION

At least one embodiment of the invention relates to a tooth cleaning device. The device can comprise a handle, a pad having a base section coupled to the handle, and wherein the base section has a front face and a back face. There are a plurality of different areas disposed on the front face of the base section. There is a first area comprising a first set of protrusions, and a second area comprising a second set of protrusions, wherein the first set of protrusions are different in shape from the second set of protrusions. In at least one embodiment, the first set of protrusions are semi-spherical protrusions, while the second set of protrusions comprise conical protrusions.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
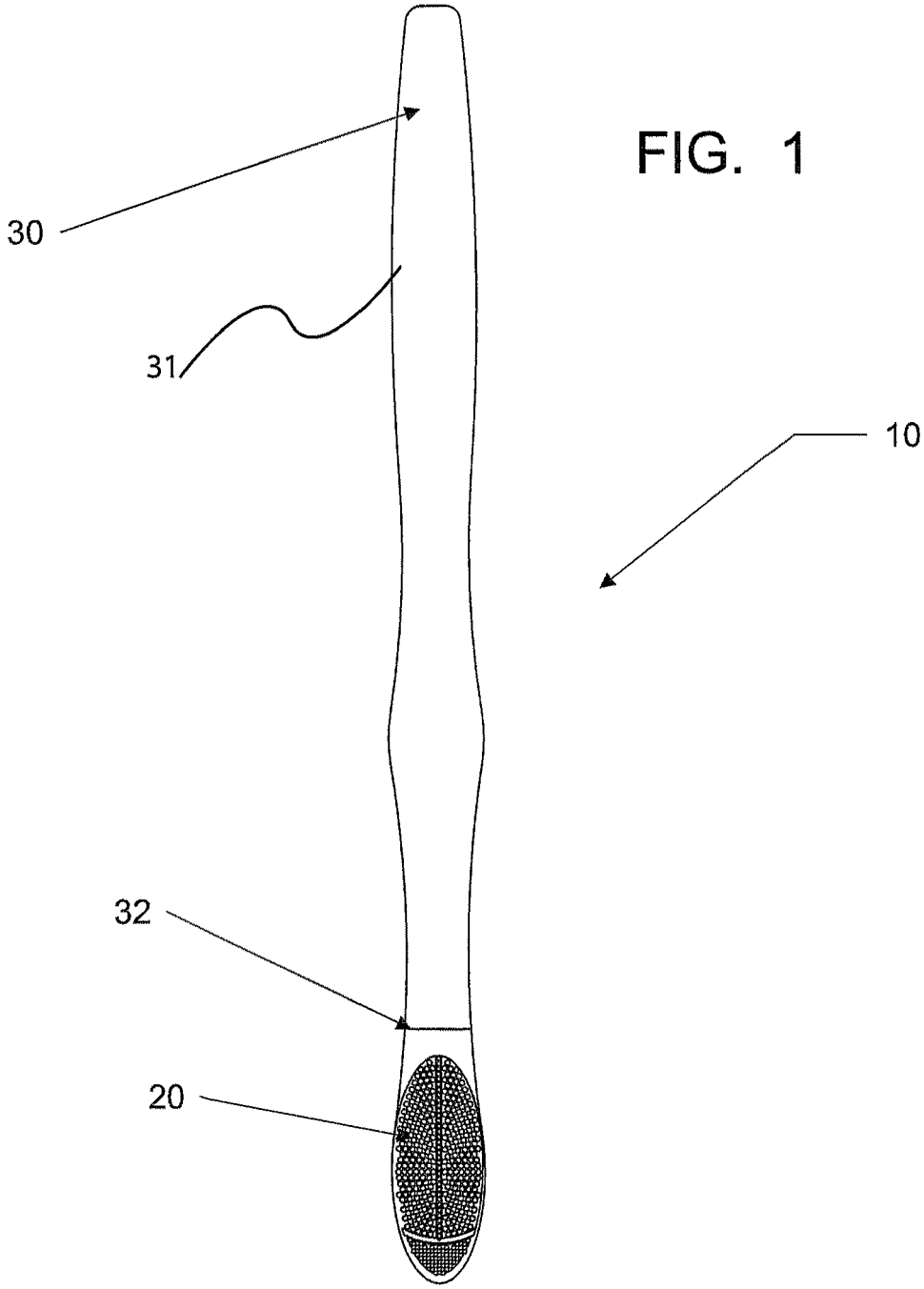
FIG. 1 is a top, plan view of the device having a pad for cleaning teeth.

Referring in detail to the drawings, FIG. 1 is a top, plan view of the device 10 having a pad for cleaning teeth. This device 10 includes a handle 30 having a body section 31 and a head section 32 forming a handle head. Coupled to head section 32 is a pad 20. Pad 20 is configured as a pad for cleaning teeth, while handle 30 is configured to allow a user to hold the handle.

Figure 2:
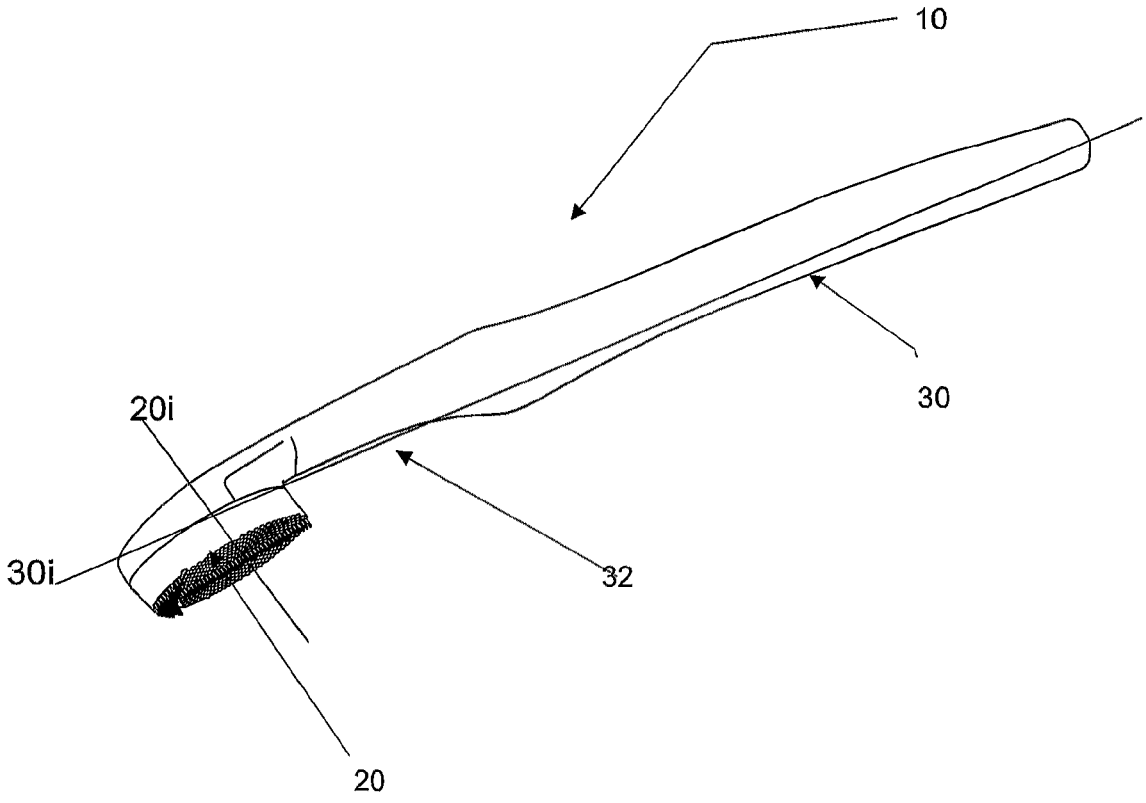
FIG. 2 is a side perspective view of the device showing the pad.
Figure 3:
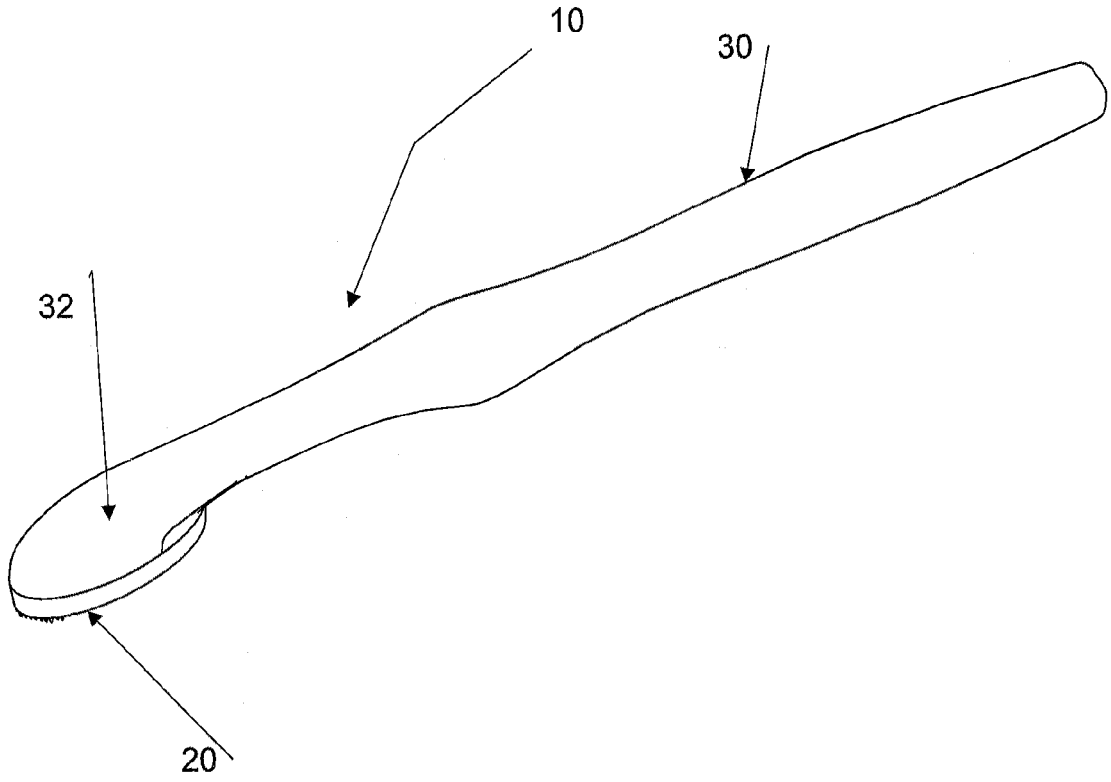
FIG. 3 is a back view of the device showing the back surface of the handle.
Figure 4:
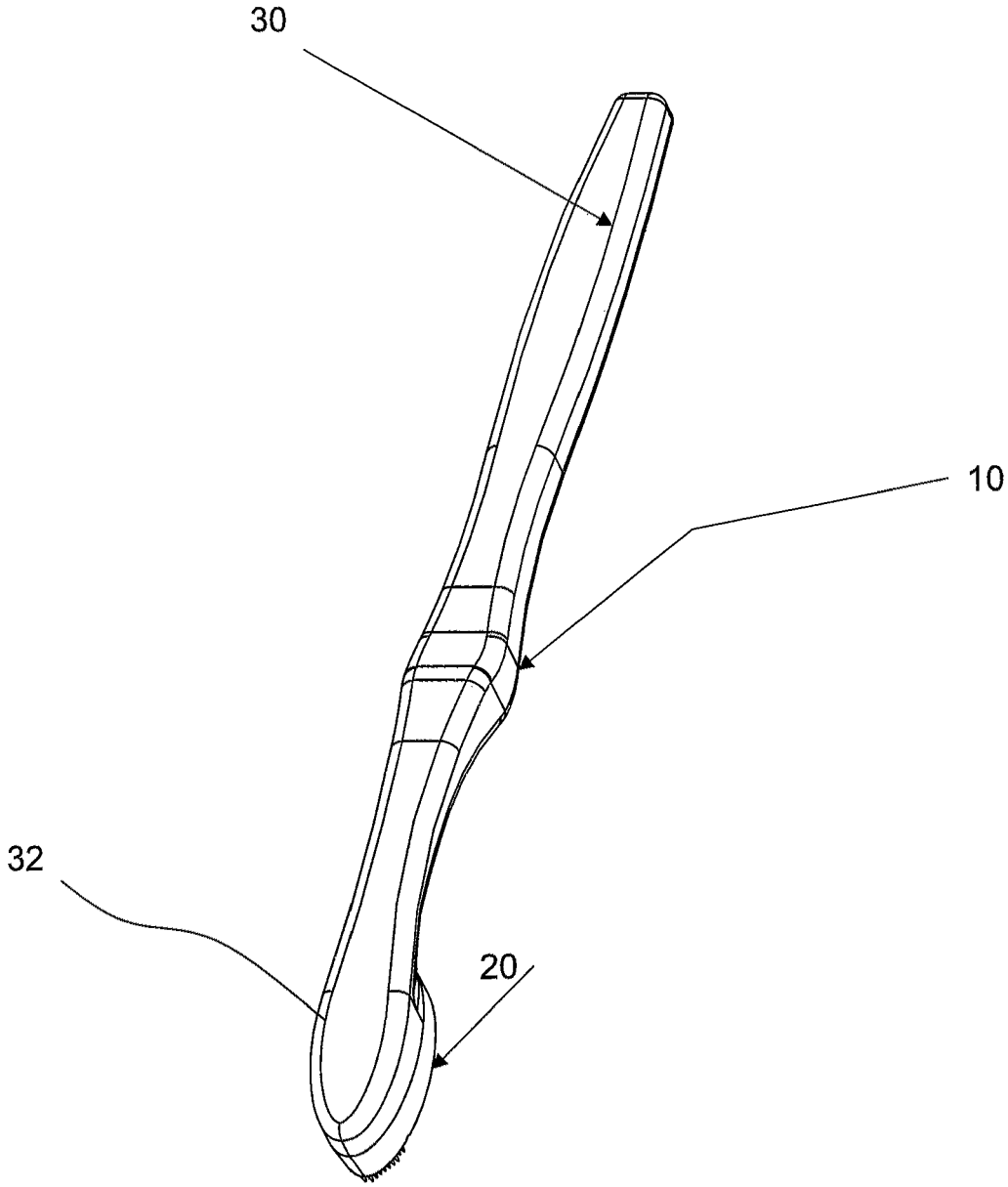
FIG. 4 is a back-perspective view of the handle showing contour lines.

These features are also shown in FIGS. 2-4 as well. FIG. 2 shows a side perspective view of the device shown in FIG. 1. In this view, this embodiment includes an axis 30*i* which extends along the longitudinal axis of handle 30. Accordingly, a user can grab handle 30, press pad 20 against his or her teeth and use the handle as leverage (if necessary) to press the pad towards the teeth to clean the teeth.

In addition, there is an additional axis 20*i* which extends substantially perpendicularly to longitudinal axis 30*i*. This additional axis forms the axis of extension of head 32 which extends out from handle 30. FIG. 3 shows a back perspective view of this design showing handle 30, head section 32 and a pad or cleaning head 20. FIG. 4 shows a back perspective view of a set of line drawings which are shown as contour lines for handle 30 and pad 20 as well.

Figure 5A:
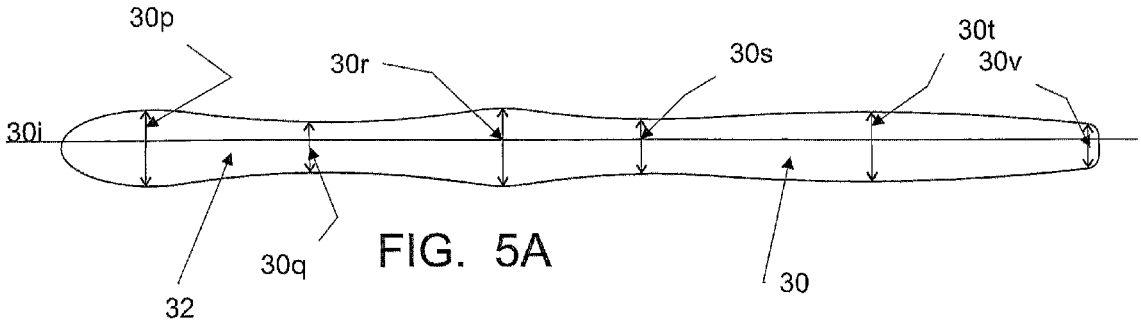
FIG. 5A is a back view of the handle.
Figure 5B:
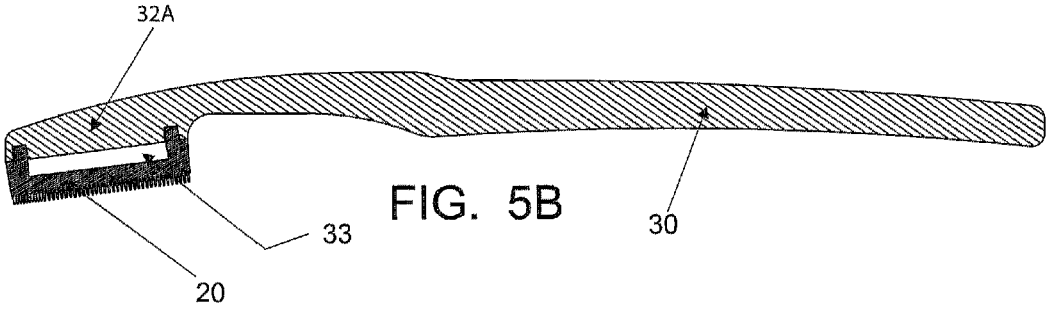
FIG. 5B is a side cross-sectional view of the device.
Figure 5C:
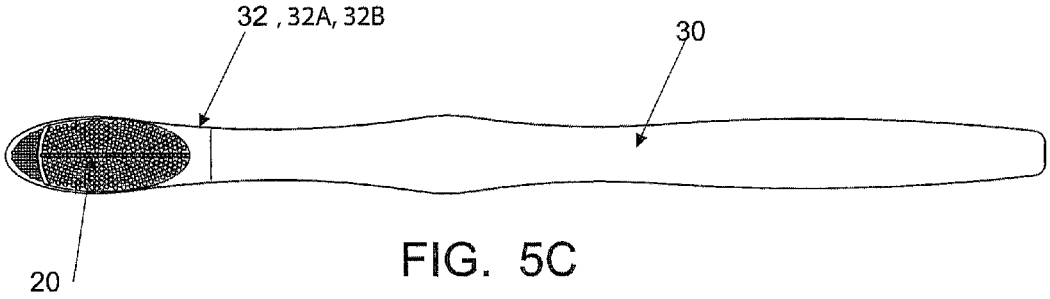
FIG. 5C is a front view of the device.

FIGS. 5A, 5B and 5C show a back view, a cross-sectional view and a front plan view of the device as well.

For example, FIG. 5A shows a back view of a handle which shows different contours and/or different widths of the handle. For example, the handle can be of a first width 30*p*, which then narrows to a second width 30*q*. Moving along the handle from the head to the tail, the handle then widens out at width 30*r*, and then narrows again at width 30*s*, only to widen again at width 30*t* and then narrow again at width 30*v*. These widths are measured along lines extending substantially perpendicular to longitudinal axis 30*i*.

Handle 30 therefore has a wider section of head 32 and the remaining extension of handle 30 is that of an undulating width to allow a user to grip the handle better.

With this design as shown in FIG. 5B, there is a cross-sectional view showing handle section 30 with head section 32A connecting to pad 20. The connection of pad 20 to head section 32A of handle 30 creates a gap 33 which is configured to provide a relief opening for allowing pad 20 to collapse. Pad 20 can be made of any suitable flexible material including but not limited to rubber, plastic, composites, etc. Gap 33 which forms a gap between a back, inner surface of pad 20 and handle head 32A, allows pad 20 to collapse into handle head 32 thereby providing some "give" or release to pad 20 if pad 20 is pressed too hard against a user's teeth.

FIG. 5C is a front view of the device which includes pad 20 handle 30 and handle head 32. Pad 20 can be coupled to handle 30 or handle head 32 in any known manner but in this example is coupled to handle head 32*a* via a friction fit and via an adhesive which couples the pad into the channel formed in the handle head (see for example pad 20*a* in FIG. 9A and channels 37*a* and 324*a* shown in FIGS. 12 and 15A).

Figure 6:
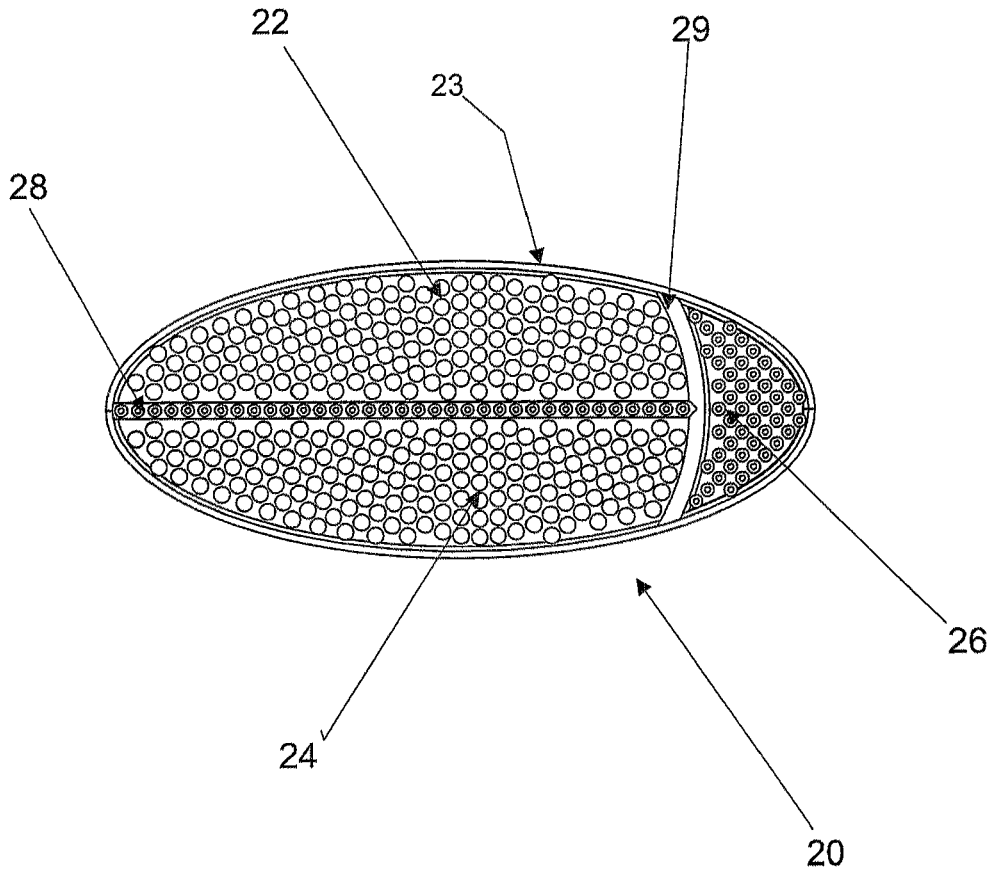
FIG. 6 is a front view of the pad.

FIG. 6 is a front, plan view of the pad 20 which contains a base section 23 having a plurality of different areas disposed thereon. A first area 22 on pad 20 can contain protrusions which are of any shape but in this case contains protrusions that are substantially semi-spherical in shape. Second section 24 is spaced opposite first section 22 and also includes protrusions as well. This section includes protrusions that can be of any suitable shape but in this case are semi-spherical in shape as well. Next, there is a third section 26 which can include protrusions which are of any suitable shape but which in this example are substantially conical in shape. Next, a fourth section 28 includes a plurality of protrusions which can be of any shape but which in this case are substantially conical in shape.

A fifth section 29 includes a gap which is a dividing opening between the third section 26 and the first 22, second 24 and fourth 28 sections. This fifth section 29 forms a relief or channel on pad 20 which allows the pad to collapse into the gap or opening 33 shown in FIG. 5B. Each of the protrusions can be formed separate or integral with the base. Therefore, with an integrally formed pad, the base section and protrusions 22*a*, 24*a*, 26*a*, and 28*a*, can be formed integral with the base section including side walls 21.

Figure 7:
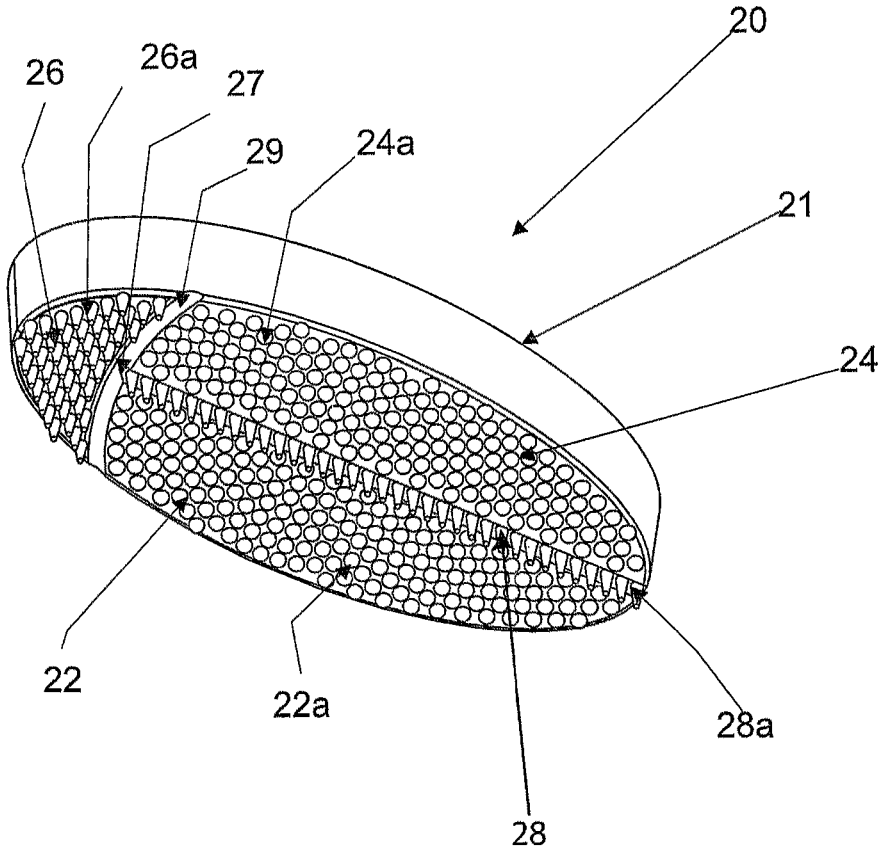
FIG. 7 is a side perspective view of the pad.

FIG. 7 shows a perspective view of pad 20 which also shows the depth of pad 20 including side walls 21, semi-spherical protrusions 22*a* and 24*a* disposed in areas 22 and 24, as well as conical protrusions 26*a* disposed in section 26. With this design, reference numeral 24*a* denotes the semi-spherical protrusions of area 24, while reference numeral 26*a* denotes the conical protrusions of area 26. There is also shown an additional indentation or channel 27 which is formed in pad 20 and which is configured to receive conical protrusions 28*a* in area 28. The differently shaped protrusions are configured so as to provide different surfaces from which to polish or clean teeth. For example, semi-spherical protrusions 24*a* are primarily configured to slide over teeth to provide a non-destructive cleaning surface for teeth. Alternatively, conical protrusions 26*a* and 28*a* are configured to provide some access between teeth to clean between two teeth and into the gums of a user. As shown in this view, side wall 21 provides an elevated side surface which is configured to space this cleaning surface or base section away from a handle head. This spacing provides for, or creates a gap 33, shown in FIG. 5B which allows pad 20 to be coupled to handle 30, while still allowing some give in pad 20.

Figure 8A:
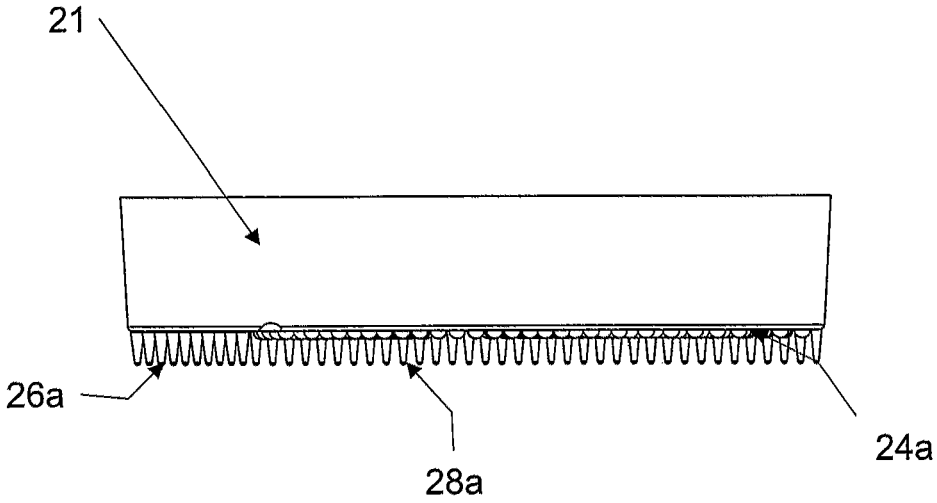
FIG. 8A is a side view of the pad.

FIG. 8A shows a view of a first embodiment of pad 20 which shows side wall 21 as well as conical protrusions 26*a* and 28*a* as well as semi-spherical protrusions 24*a*. This view shows the extension difference in length between the conical protrusions 26*a* and 28*a* and the semi-spherical protrusions 24*a*.

Figure 8B:
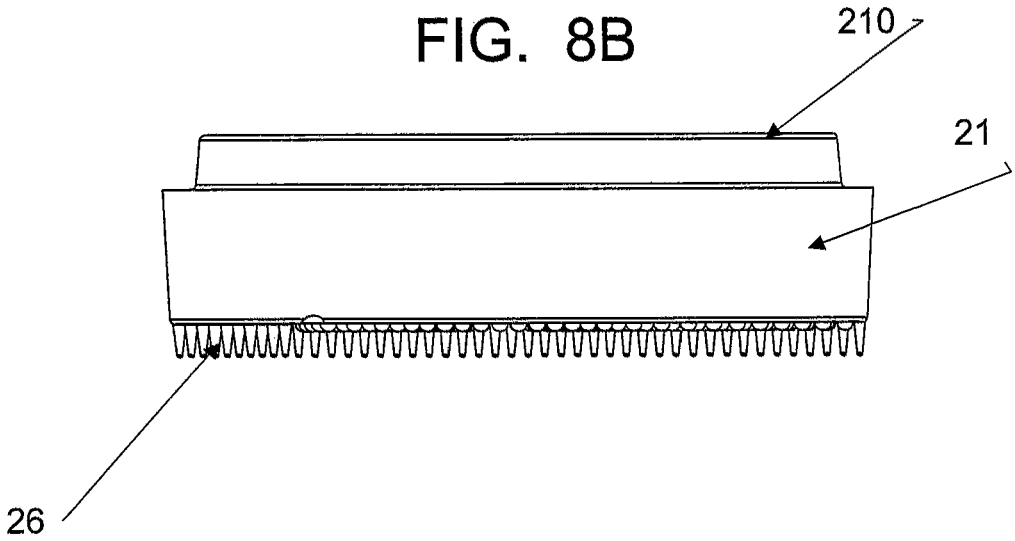
FIG. 8B is a side view of another embodiment of the pad.
Figure 11:
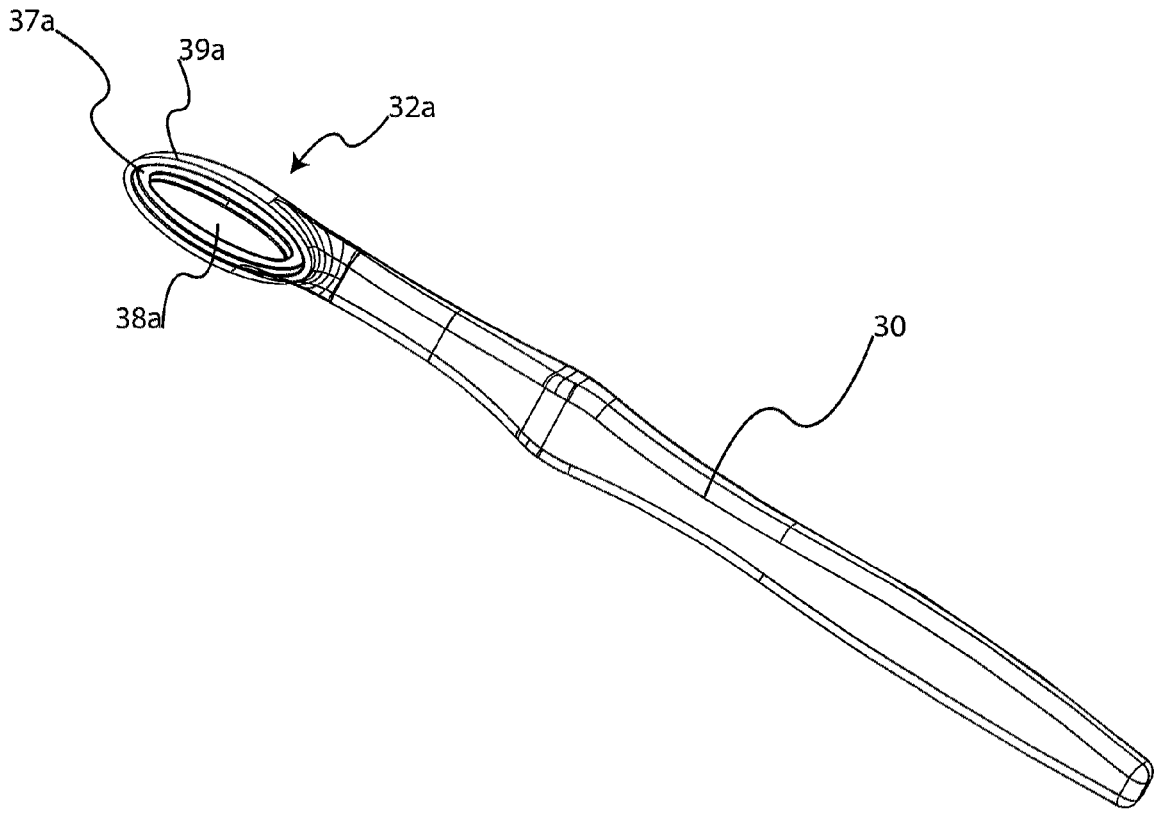
FIG. 11 is a perspective view of an embodiment shown by way of example in FIG. 5B.

In addition, FIG. 8B shows another embodiment of a pad which includes a back extension member 210 which is configured to couple to an associated head of a handle such as that shown in FIG. 11.

Figure 9A:
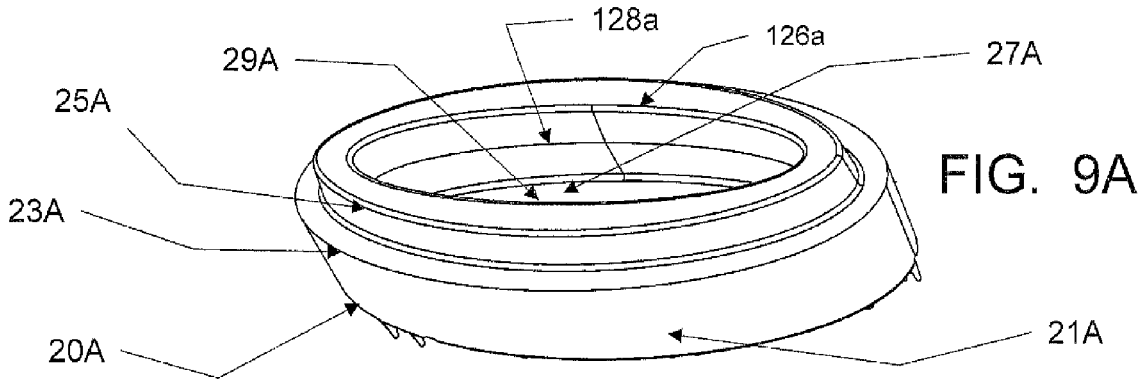
FIG. 9A is a back perspective view of another embodiment of a pad.
Figure 9B:
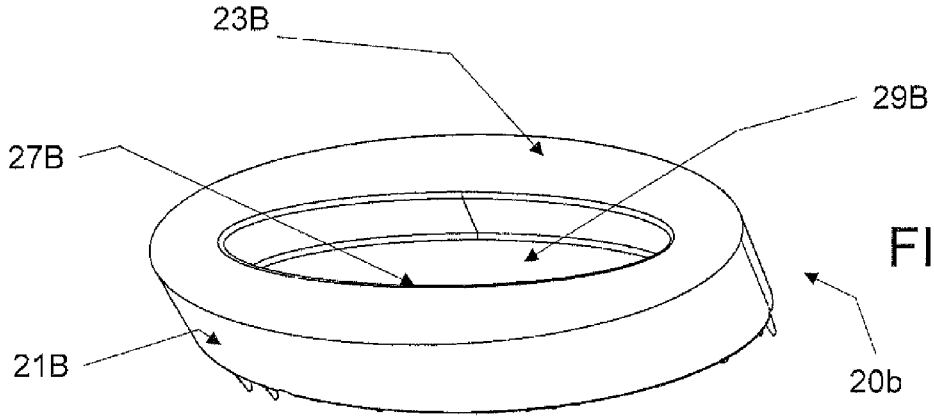
FIG. 9B is a back perspective view of another embodiment of a pad.
Figure 9C:
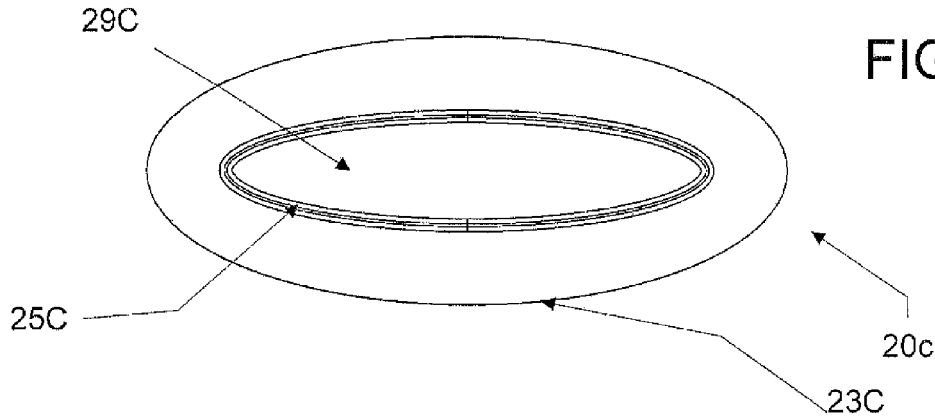
FIG. 9C is a back view of another embodiment of a pad.

FIGS. 9A, 9B and 9C show different embodiments of the pad, which include a first style pad 20*a*, a second style pad 20*b*, and a third style pad 20*c*.

First style pad 20*a* as shown in FIG. 9A includes a base section including a side wall 21*a*, which rises to a first back section 23*a*, which is substantially perpendicular to first side wall 21*a*. A second side wall 25*a* then rises perpendicular to first back section 23*a*, and parallel to first side wall 21*a*. This then forms another back section or second back section 126*a*, which is bounded on the inside by perpendicular wall 128*a* forming open section 27*a*. In addition, there is an inside back wall or section 29*a* which forms a back surface substantially parallel to and opposite to the opposite cleaning surface having protrusions.

In at least one embodiment, pad 20, pad 20*a*, pad 20*b*, and pad 20*c* is formed from a flexible material, such as rubber, including natural rubber, synthetic rubber, plastic or other types of materials such as a composite. Therefore, with respect to these pads such as pad 20*a*, back surface 29*a* can collapse back towards handle 30 including the surface 38 (See FIGS. 10A and 10B) as well.

FIG. 9B shows a perspective view of another embodiment 20*b* which shows a base section including a side surface 21*b*, a first back surface 23*b* an interior back surface 29*b* and an opening or gap 27*b* which allows back surface 29*b* to collapse therein.

FIG. 9C shows a back top view of another embodiment 20*c*, which shows a base section including a back surface 23*c*, recessed surface 25*c*, and back surface 29*c* which is opposite an associated cleaning surface having protrusions.

While these three embodiments are shown, other modifications can be made to these embodiments.

Figure 10A:
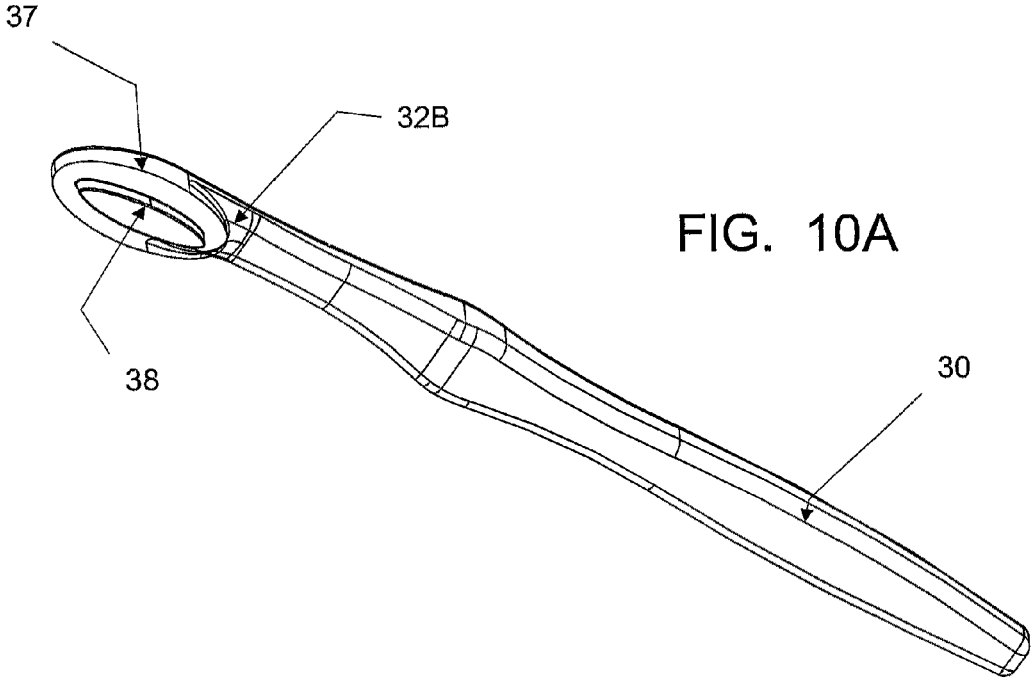
FIG. 10A is a front perspective view of one embodiment of a handle.

FIG. 10A shows one embodiment of a handle 30. In this view, there is shown handle 30 as well as head section 32*b* which includes a head having a first front surface 37 and a second raised inner front surface 38. First front surface 37 is recessed behind second front surface 38 and extends substantially parallel to second front surface 38. First front surface 37 forms a contact surface to contact with back walls of a pad such as back wall or surface 23*b*, (FIG. 9B) back wall or surface 23*a*, back wall or surface 23*b*, and back wall or surface 23*c*, as well as back wall or surface 25*c*.

Figure 10B:
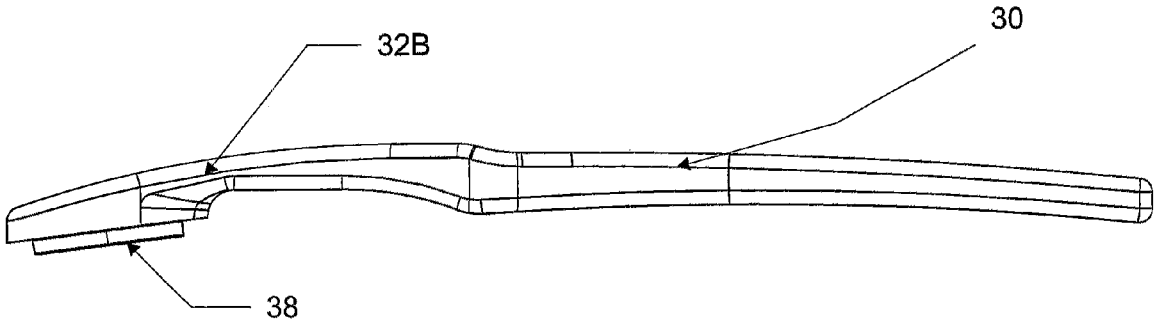
FIG. 10B is a side view of the handle of FIG. 10A.

FIG. 10B shows a side view of this handle which includes raised inner back surface 38 projecting out from head 32*b*.

FIG. 11 is a side perspective view of a handle which shows a handle section 30, a head section 32*a*, an outer rim 39*a*, an inner groove 37*a*, and a centrally located platform 38*a*. Inner groove 37*a* is rounded, in the form of a substantially oval shaped groove which is surrounded by outer rim 39*a*. In a central region of head 32*a* is a platform 38*a* which is used to support a pad once it is coupled to the head. The outer rim 39*a*, groove 37*a* and platform 38*a* are substantially oval shaped in cross-section and can be formed in a different shape such as circular shaped in cross section if necessary. Outer rim 39*a* is molded within head 32*a* and includes side walls which add lateral stability to the pad once the pad is coupled to the head. Groove 37*a* provides a recessed attachment surface which is configured to receive a pad such as pad 20, 20*a*, 20*b*, 20*c* of FIGS. 9A, 9B, and 9C or 220 of FIG. 15D. Central platform 38*a* is configured to be spaced apart from an associated pad such as pad 20 (See FIG. 5B) so as to form a gap 33 allowing pad 20 to collapse towards central platform 38*a*. Central platform 38*a* and the corresponding side walls therefore forms a support surface for this head.

Figure 12:
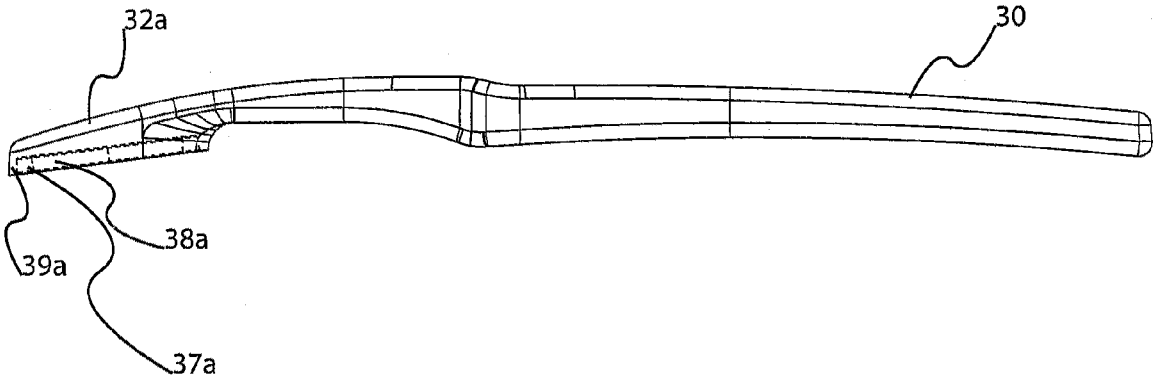
FIG. 12 is a side view of the handle and head as shown in FIG. 11.

FIG. 12 shows a side view of this handle design showing handle section 30, head section 32*a*, rim 39*a*, groove 37*a*, and platform 38*a* as well.

Figure 13:
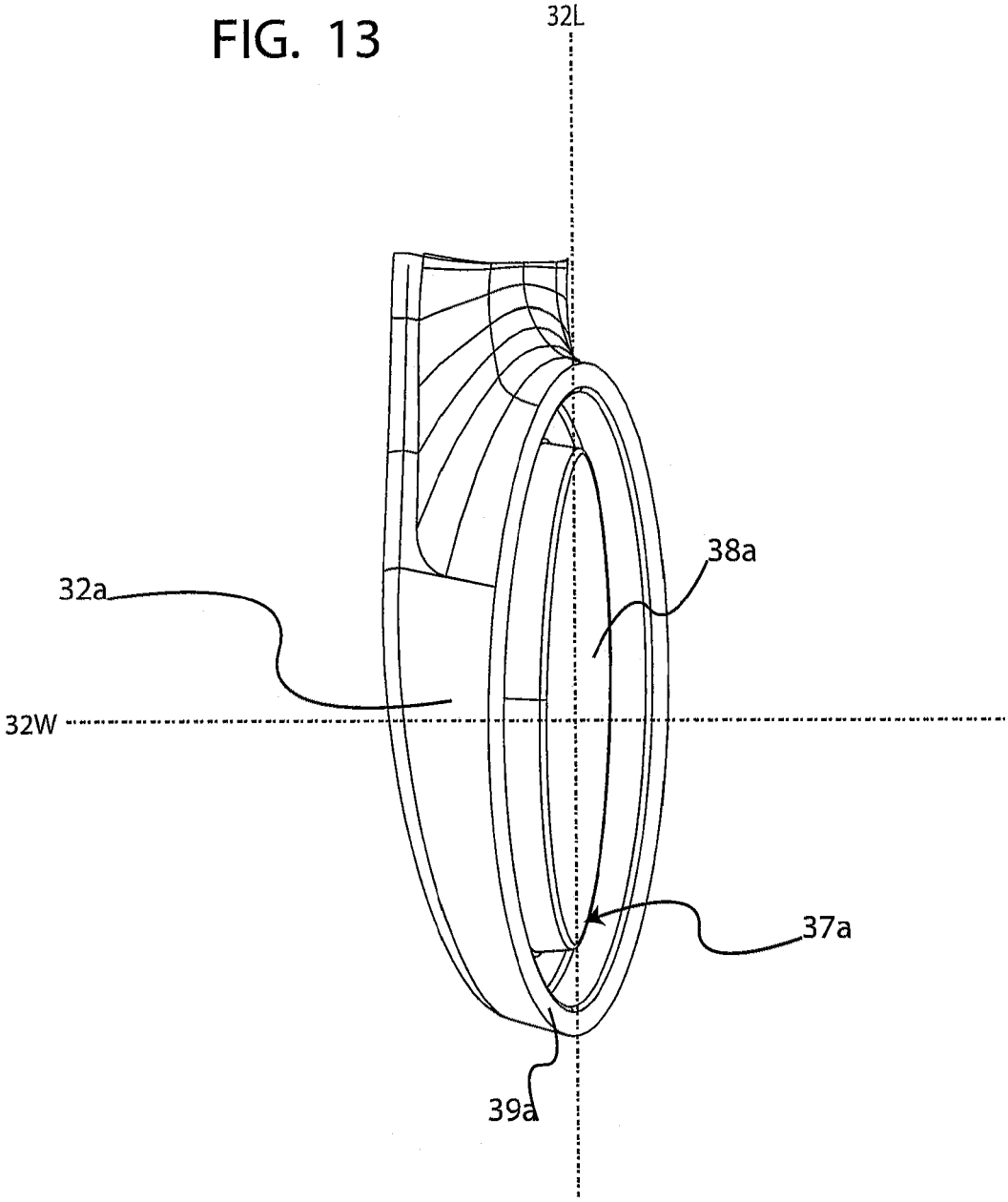
FIG. 13 is a side perspective view of the head shown in FIG. 12.

FIG. 13 shows a side-perspective view of the handle head 32*a* which shows outer rim 39*a*, inner groove 37*a*, and central platform 38*a*. In this view, central platform 38*a*, groove, 37*a* and rim 39*a* each extend lengthwise along longitudinal axis 32L and widthwise along latitudinal axis 32W. As described above, the shapes of each of these objects can be dimensioned into different shapes. However, in this example, each of platform 38*a*, inner groove 37*a*, and rim 39*a* are configured to extend in a longer direction along longitudinal axis 32L than along latitudinal axis 32W. This dimensioning results in a substantially oval shape.

Figure 14A:
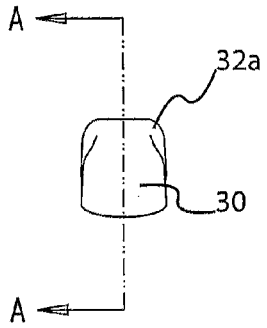
FIG. 14A is an end view of the handle.
Figure 14B:
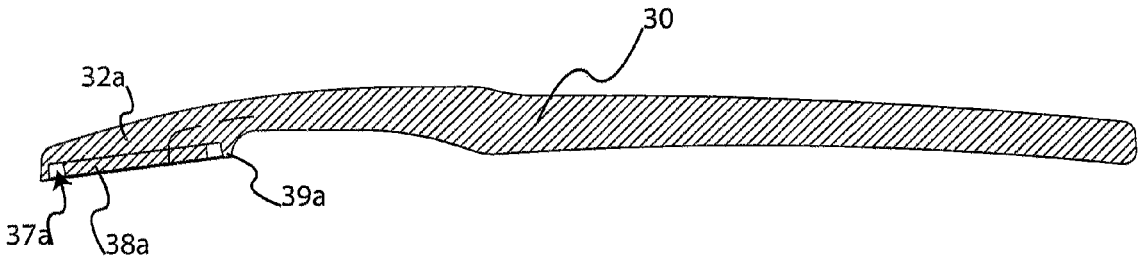
FIG. 14B is a side cross-sectional view taken along the line A-A shown in FIG. 14A.

FIG. 14A shows an end view of handle 30, while FIG. 14B shows a side cross-sectional view of handle 30 and head 32*a*. This view shows the spacing gap of groove 37*a* which is spaced between rim 39*a* and central platform 38*a*.

Figure 15A:
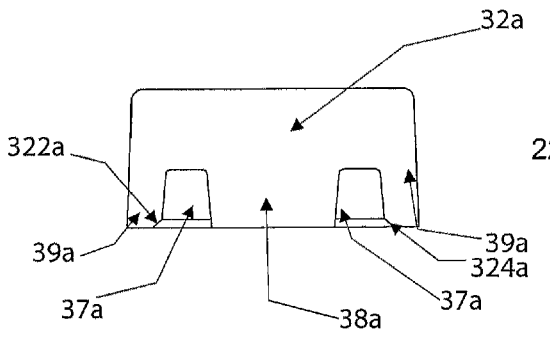
FIG. 15A is an end cross-sectional view of a handle head.

FIG. 15A shows an end cross-sectional view of a head 32*a* which includes a plurality of different sections. Head 32*a* can be coupled to any of the designs of handle 30 and can be used in a manner similar or interchangeably with the other heads shown including heads 32, 32*a* and 32*b*. Head 32*a* includes outer sections 39*a*, forming outer side walls of a body. There is also a center section 38*a* as well. Formed in this body is a groove 37*a*, wherein groove 37*a* each have tapered or beveled openings 322*a* and 324*a*, forming a wider than normal opening for insertion of a pad. Essentially, this cross-sectional view of the handle head forming a base is formed as a handle head having a substantially W shaped cross-section.

Figure 15C:
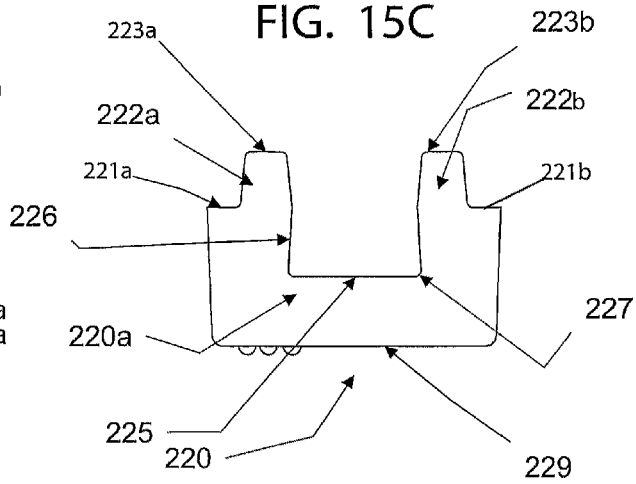
FIG. 15C is an end cross-sectional view of another embodiment of a pad for use with the handle head of FIGS. 15A, and 15B.
Figure 15B:
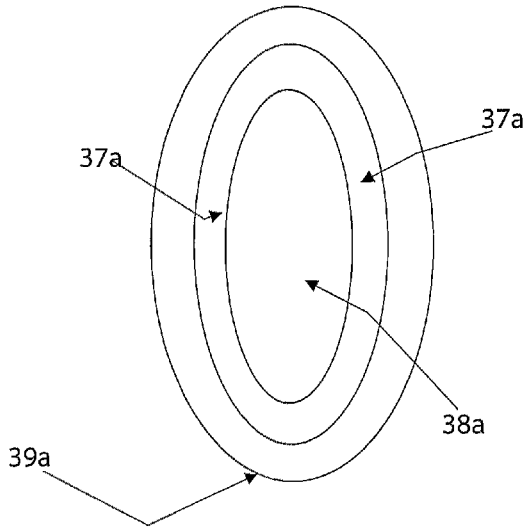
FIG. 15B is a top view of the handle head shown in FIG. 15A.

FIG. 15B shows a top view of this head showing groove 37*a* actually forming a single opening in the form of a ring formed in head 32*a*. In addition, center region platform 38*a* is shown surrounded by the recessed ring formed by recess or groove 37*a*.

FIG. 15C shows a cross-sectional view of another embodiment of a pad 220. Pad 220 includes a base section 220*a* which forms the body region of this pad. This view shows pad 220 including side walls 222*a* and 222*b*, each having extended back surfaces 223*a* and 223*b* which extend substantially parallel to the front cleaning surface. There are also inner side walls 226 which extend towards a back surface 225. Disposed in this back surface 225 is at least one recess 227 which is recessed in towards side walls 221*a* and 222*b*. An opposite cleaning surface 229 forming a base is positioned parallel to, but opposite back inner surface 225. When this pad is used, this pad can collapse allowing surface 225 to collapse into a surface of a handle such as surface 38*a*.

Figure 15D:
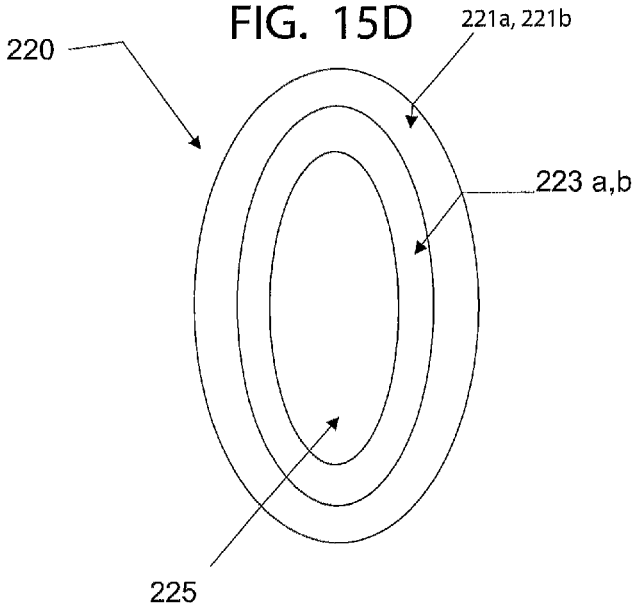
FIG. 15D is a back or inside view of the pad of FIG. 15C.

FIG. 15D shows a back view of this device or pad 220 which includes back surfaces 221*a* and 221*b* as well as inner, raised back surface 223*a*, and 223*b*, along with inner recessed surface 225. With this design, pad 220 can be used as a collapsible pad which gives when a user cleans the teeth by applying the pad to the teeth.

With this design, pad such as pad 20 or pad 220 can be coupled to a head such as head 32, 32*a*, 32*b*, wherein surfaces 223*a* and 223*b* are coupled to rim or groove 37*a* in any suitable manner such as through the use of an adhesive such as but not limited to glue. Back surface 221 and 222 can also be coupled to rim 39*a* via an adhesive as well. Back surface 225 could however, be spaced apart from platform or raised surface 38*a* to provide a spacing such as spacing 33 shown in FIG. 5B. This then results in a pad, such as pad 220, being secured to the head such as head 32*a* in a stable manner, while still allowing some flexibility to allow the cleaning surface 22, 24, 26, 28 to bend to collapse into region 33 to allow this cleaning surface to mold itself around the article being cleaned such as teeth.

Figure 16A:
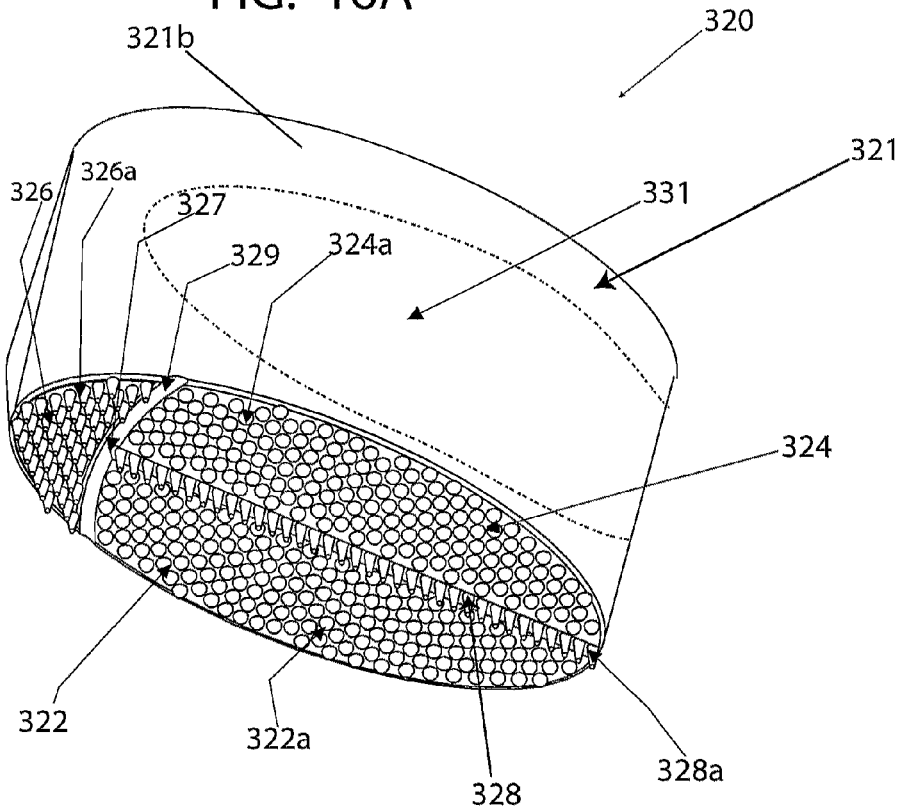
FIG. 16A is a side, perspective view of another embodiment.
Figure 16B:
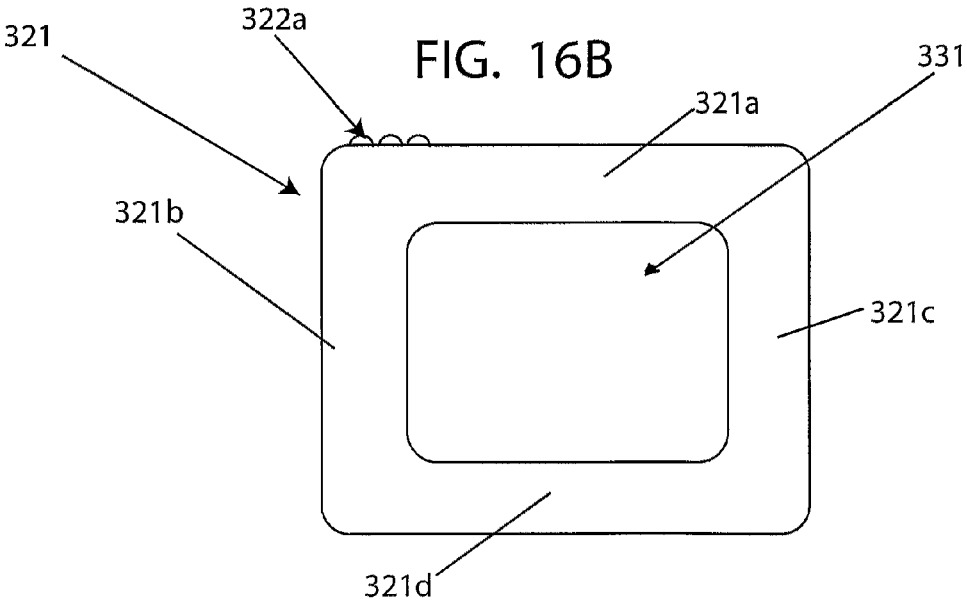
FIG. 16B is an end view of the embodiment shown in FIG. 16A.

FIGS. 16A and 16B show another embodiment of the pad which includes a finger held pad 320. Finger held pad is substantially similar to pad 20 but it allows for the insertion of a user's digit such as a finger into the pad. Pad 320 includes side walls 321, and a finger insertion cavity 331 for insertion of a finger into the pad. Cavity 331 (See FIG. 16B) is formed as a recess in the pad to receive a user's finger. The pad cleaning surface includes a plurality of different cleaning sections including sections 322, 324, 326, 328, wherein each of these cleaning areas or sections include different types of protrusions 322*a*, 324*a*, 326*a*, and 328*a*. These protrusions can be of any shape. However, with areas 322 and 324, these areas include semi-spherical protrusions 322*a* and 324*a*, which are rounded protrusions which can be used to clean a surface of a tooth. The other areas 326 and 328 include respective protrusions 326*a* and 328*a* which are conical shaped or substantially conical or frusto-conical shaped which in this example, extend beyond the extension of protrusions 322 and 324. In addition, there are grooves 327 and 329 wherein groove 327 serves to seat protrusions 328*a* while groove 329 serves to separate area 326 from areas 324, and 322.

FIG. 16B shows an end view of the pad 320 which shows a front wall 321*a*, two side walls 321*b*, 321*c*, and a back wall 321*d*. Front wall includes the front face which supports the protrusions 322*a*, 324*a*, 326*a*, and 328*a*, as well as grooves 327 and 329. In this way the cavity 331 is configured to receive a finger of a user wherein this cavity including these side walls then surrounds the finger to provide support for a user handling the pad. In this view, only some of the protrusions 322*a* are shown, however, this embodiment includes or can include all of the protrusions shown in FIG. 16A.

With this design, there is shown a finger usable design which can be used to clean a user's teeth without using a separate handle. Because the finger inserts into hole or cavity 331, it allows a user to manually manipulate the pad to clean the user's teeth.

This design ultimately allows a user a more gentle way to clean the user's teeth without further damaging the teeth by removing enamel or other protective coatings.

Accordingly, while a few embodiments of the present invention have been shown and described, it is to be understood that many changes and modifications may be made thereunto without departing from the spirit and scope of the invention as defined in the appended claims.

What is claimed is:

1. A tooth cleaning device comprising:

a) a handle;

b) a pad having a base section coupled to said handle, said base section having a substantially hollow front face and a back face, said back face being spaced apart from said handle; and c) a plurality of different areas disposed on said front face of said base section comprising;

i) a first area comprising a first set of protrusions comprising rounded, semi-spherical protrusions; and ii) a second area comprising a second set of protrusions, wherein said first set of protrusions are different in shape from said second set of protrusions, wherein said first area does not include said second set of protrusions and said second area does not include said first set of protrusions.

2. The tooth cleaning device as in claim 1, wherein said second area of protrusions comprise a plurality of conical shaped protrusions.

3. The tooth cleaning device as in claim 1, further comprising at least one additional area of protrusions, comprising at least one third area of protrusions, wherein said at least one third area of protrusions comprise a plurality of conical shaped protrusions.

4. The tooth cleaning device as in claim 3, wherein said second area comprises protrusions that are substantially conical shaped.

5. The tooth cleaning device as in claim 4, wherein said third area of protrusions comprises a substantially centrally extending line of protrusions.

6. The tooth cleaning device as in claim 5, further comprising at least one fourth area comprising a plurality of substantially semi-spherical shaped protrusions, with said first area and said fourth area being divided by said third area of protrusions.

7. The tooth cleaning device as in claim 5, further comprising at least one groove positioned between said at least one second area and at least one of said first and third area.

8. The tooth cleaning device as in claim 1, wherein said base section has a plurality of side walls, with said side walls being coupled to said handle.

9. The tooth cleaning device as in claim 8, wherein said side walls are coupled to said handle via an adhesive.

10. The tooth cleaning device as in claim 1, wherein said handle comprises a handle base section, and at least two channels disposed in said base section.

11. The tooth cleaning device as in claim 10, wherein said handle base section has a cross-section that is substantially W-shaped.

12. The tooth cleaning device as in claim 10, wherein said handle base section comprises a first side wall, a second side wall, an inner wall, and a plurality of channels formed in said first side wall and said second side wall.

13. The tooth cleaning device as in claim 10, wherein said handle base section is substantially oval shaped.

14. A tooth cleaning device comprising:

a) a handle;

b) a pad having a base section coupled to said handle, said base section having a front face, a back face and a plurality of side walls; and c) a plurality of different areas disposed on said front face of said base section comprising;

i) a first area comprising a first set of protrusions, in a substantially semi-spherical shape;

ii) a second area comprising a second set of protrusions in a substantially conical shape;

iii) a third area of protrusions formed as a substantially conical shape; and iv) a fourth area of protrusions formed as a substantially semi-spherical shape wherein said first area does not include said second set of protrusions and said second area does not include said first set of protrusions, said first and fourth areas of protrusions being separated by one of the second and third areas of protrusions.

15. A tooth cleaning device comprising:

a) a handle;

b) a pad having a base section said base section having a front face, a back face and a plurality of side walls and a cavity disposed therein; and c) a plurality of different areas disposed on said front face of said base section comprising;

i) a first area comprising a first set of protrusions, in a substantially semi-spherical shape;

ii) a second area comprising a second set of protrusions in a substantially conical shape;

iii) a third area of protrusions formed as a substantially conical shape; and iv) a fourth area of protrusions formed as a substantially semi-spherical shape wherein said first area does not include said second set of protrusions and said second area does not include said first set of protrusions, said first and fourth areas of protrusions being separated by one of the second and third areas of protrusions.

16. The device as in claim 15, wherein said cavity is configured to receive a user's finger.

17. The device as in claim 16, wherein said pad has a front wall having said front face, a back wall having said back face, and wherein said cavity is formed from said front wall, said back wall and said side walls of said pad.

* * * * *